US010201465B2

(12) United States Patent
Tsukada et al.

(10) Patent No.: US 10,201,465 B2
(45) Date of Patent: Feb. 12, 2019

(54) ARMREST LOCKING MECHANISM AND INTEGRATED BED HAVING SAME

(71) Applicant: Panasonic Intellectual Property Management Co., Ltd., Osaka (JP)

(72) Inventors: Shohei Tsukada, Hyogo (JP); Yoshinori Inaba, Osaka (JP); Yohei Kume, Osaka (JP); Hideo Kawakami, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 308 days.

(21) Appl. No.: 14/997,534

(22) Filed: Jan. 17, 2016

(65) Prior Publication Data

US 2016/0128882 A1 May 12, 2016

Related U.S. Application Data

(63) Continuation of application No. PCT/JP2015/003098, filed on Jun. 22, 2015.

(30) Foreign Application Priority Data

Aug. 29, 2014 (JP) ..... 2014-175254

(51) Int. Cl.
*A61G 5/12* (2006.01)
*A47C 7/54* (2006.01)
(Continued)

(52) U.S. Cl.
CPC ..... *A61G 5/125* (2016.11); *A47C 7/54* (2013.01); *A61G 1/017* (2013.01); *A61G 5/00* (2013.01);
(Continued)

(58) Field of Classification Search
CPC ..... A61G 5/12; A61G 5/125; A61G 5/006; A61G 5/00; A61G 5/02; A61G 7/165;
(Continued)

(56) References Cited

U.S. PATENT DOCUMENTS 3,382,000 A * 5/1968 Sully ..... A61G 5/12 297/411.36
3,993,351 A * 11/1976 Rodaway ..... A61G 5/12 297/411.36
(Continued)

FOREIGN PATENT DOCUMENTS

CN 101980680 2/2011
JP 5-028249 U 4/1993
(Continued)

OTHER PUBLICATIONS

International Search Report of PCT application No. PCT/JP2015/003098 dated Jul. 21, 2015.
(Continued)

*Primary Examiner* — Robert G Santos
*Assistant Examiner* — David R Hare
(74) *Attorney, Agent, or Firm* — Panasonic IP Management; Kerry S. Culpepper

(57) ABSTRACT

An armrest locking mechanism includes a lever and an armrest lock. The lever is configured to unlock a movement of an armrest. The armrest lock is configured to unlock a movement of the lever.

2 Claims, 9 Drawing Sheets

(51) Int. Cl.

| | |
|---|---|
| ***A61G 1/017*** | (2006.01) |
| ***A61G 5/00*** | (2006.01) |
| ***A61G 5/02*** | (2006.01) |
| ***A61G 7/00*** | (2006.01) |
| ***A61G 7/05*** | (2006.01) |
| ***A61G 7/053*** | (2006.01) |
| ***A61G 7/16*** | (2006.01) |

(52) U.S. Cl.
CPC ..... *A61G 5/006* (2013.01); *A61G 5/02* (2013.01); *A61G 5/12* (2013.01); *A61G 7/00* (2013.01); *A61G 7/05* (2013.01); *A61G 7/053* (2013.01); *A61G 7/0509* (2016.11); *A61G 7/16* (2013.01); *A61G 7/165* (2016.11)

(58) Field of Classification Search
CPC ..... A61G 7/0509; A61G 7/16; A61G 7/053; A61G 7/05; A61G 7/00; A61G 1/017; A47C 7/54
See application file for complete search history.

(56) References Cited

U.S. PATENT DOCUMENTS 4,240,169 A * 12/1980 Roos ..... A61G 3/06 297/DIG. 4
4,244,623 A * 1/1981 Hall ..... A47C 1/03 297/115
4,489,981 A * 12/1984 Goletski ..... A61G 5/12 297/411.36
4,968,094 A * 11/1990 Froyland ..... A61G 5/12 297/411.36
5,265,938 A * 11/1993 Melhuish ..... A47C 1/03 297/411.36
5,368,365 A * 11/1994 Feldberg ..... A47C 1/03 297/411.36
5,382,079 A * 1/1995 Wilson ..... A47C 1/03 297/411.35
5,388,892 A * 2/1995 Tornero ..... A47C 1/03 248/409
5,393,125 A * 2/1995 Watson ..... A47C 1/03 248/118.3
5,438,722 A * 8/1995 Jayamanne ..... A61G 5/006 5/425
5,439,267 A * 8/1995 Peterson ..... A47C 1/03 297/411.2
5,664,842 A * 9/1997 Tseng ..... A47C 1/03 297/353
5,795,026 A * 8/1998 Dral ..... A47C 1/03 297/411.2
6,076,892 A * 6/2000 Van Hekken ..... A47C 1/03 297/411.35
6,209,840 B1 * 4/2001 Chen ..... A47C 1/03 248/118
6,315,362 B1 * 11/2001 Chuang ..... A47C 1/03 297/411.36
6,419,323 B1 * 7/2002 Chu ..... A47C 1/03 297/411.35
6,460,932 B1 * 10/2002 Kopish ..... A47C 1/03 248/118.3
6,519,794 B1 * 2/2003 Aarestad ..... A61G 7/0507 5/428
6,540,300 B2 * 4/2003 Piretti ..... A47C 1/03 297/411.35
6,840,582 B2 * 1/2005 Burwell ..... A47C 7/38 297/411.36
7,246,859 B2 * 7/2007 Igarashi ..... A47C 1/03 297/411.36
7,434,887 B1 * 10/2008 Hsien ..... A47C 1/03 297/411.36
7,770,979 B2 * 8/2010 He ..... A47C 1/03 297/411.36
7,828,389 B2 * 11/2010 Oda ..... A47C 1/03 297/411.35
8,292,314 B1 * 10/2012 Schaal ..... A61G 5/10 280/250.1
9,351,575 B2 * 5/2016 Hector ..... A47C 7/54
9,861,205 B2 * 1/2018 Hector ..... A47C 1/03
2011/0030138 A1 * 2/2011 Kawakami ..... A61G 5/006 5/2.1
2013/0074256 A1 * 3/2013 Tsukada ..... A61G 7/16 5/81.1 R
2013/0307308 A1 * 11/2013 Hankins ..... A61G 5/12 297/411.38
2015/0082537 A1 * 3/2015 Ohta ..... A61G 5/04 5/2.1

FOREIGN PATENT DOCUMENTS

| | | |
|---|---|---|
| JP | 10-262779 | 10/1998 |
| JP | 2002-191465 | 7/2002 |
| JP | 5554877 B | 7/2014 |
| WO | 2010/113413 | 10/2010 |

OTHER PUBLICATIONS

English Translation of Chinese Search Report dated Oct. 25, 2016 for the related Chinese Patent Application No. 201580001117.4.
The Extended European Search Report dated Sep. 12, 2016 for the related European Patent Application No. 15801306.0.

* cited by examiner

ARMREST LOCKING MECHANISM AND INTEGRATED BED HAVING SAME

BACKGROUND

1. Technical Field

The present invention relates to an armrest locking mechanism and an integrated bed having the same.

2. Background Art

When a caregiver transfers an aged person or a sick person who is bedridden (hereinafter, referred to as a care receiver) between a bed and a wheelchair, the transferring burdens the caregiver, and at this time, the caregiver may hurt his/her waist. Thus, a bed in which a part is freely divided and the part can be used as a wheelchair has been proposed (refer to PTL 1).

FIG. 8 is a perspective view of bed 1 in the related art. In bed 1, the care receiver on the bed surface of bed 1 can be easily transferred to wheelchair section 3 by separating wheelchair section 3 from bed main body portion 2. A pair of fences 4 of wheelchair section 3 can be used as armrests. When wheelchair section 3 is connected, fences 4 are removed from an insertion hole of wheelchair section 3 and moved to insertion hole 5 of bed main body portion 2 so as to be used as a side frame of bed 1.

Bed 1 with such a configuration can reduce a burden on the caregiver when the caregiver transfers the care receiver between wheelchair section 3 and bed 1.

CITATION LIST

Patent Literature

PTL 1: Japanese Patent No. 5554877

SUMMARY

The present invention provides an armrest locking mechanism in which an armrest is not easily moved by an unexpected motion or the like of a care receiver and a caregiver can easily move the armrest.

An armrest locking mechanism of the present invention includes a lever and an armrest lock. The lever is configured to unlock movement of an armrest. The armrest lock is configured to unlock movement of the lever.

According to the armrest locking mechanism of the present invention, the armrest is not easily moved by an unexpected motion or the like of the care receiver and the caregiver can easily move the armrest.

DETAILED DESCRIPTION OF PREFERRED EMBODIMENT

Prior to the description of an exemplary embodiment of the present invention, problems of bed 1 in the related art will be briefly described. In bed 1, the displacement of fences 4 requires labor of the caregiver and thus the usability may be deteriorated. In addition, as an armrest in which fences 4 can be vertically extended and contracted, a configuration in which fences 4 are accommodated under bed 1 when being integrated is considered. However, in a case of such a configuration, when a part of bed 1 is used as a wheelchair, the armrests may be moved downward due to an unexpected motion of the care receiver.

Hereinafter, the exemplary embodiment of the present invention will be described with reference to the drawings. The same reference signs are given to the same constituents and the description thereof may not be repeated. In order for the drawings to be easily understood, respective constituents are mainly schematically illustrated.

Figure 1A:
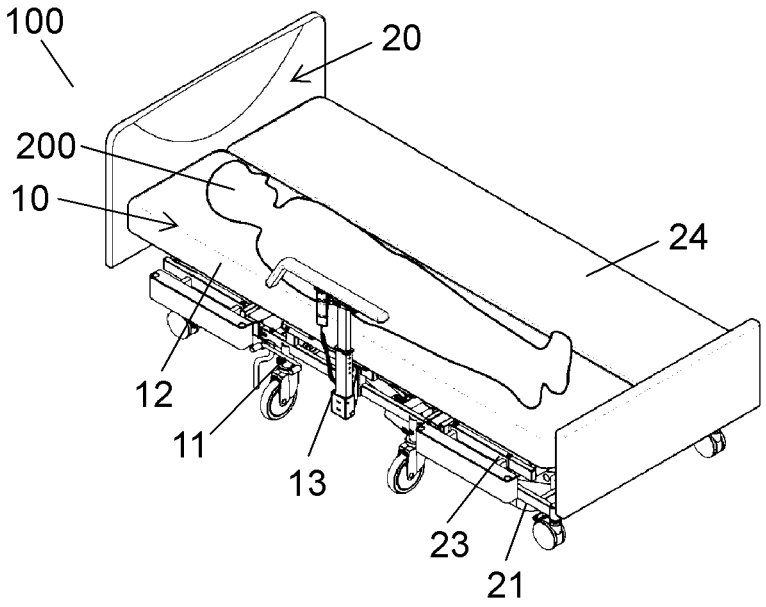
FIG. 1A is a perspective view illustrating an integrated state of an integrated bed according to an exemplary embodiment of the present invention.
Figure 1B:
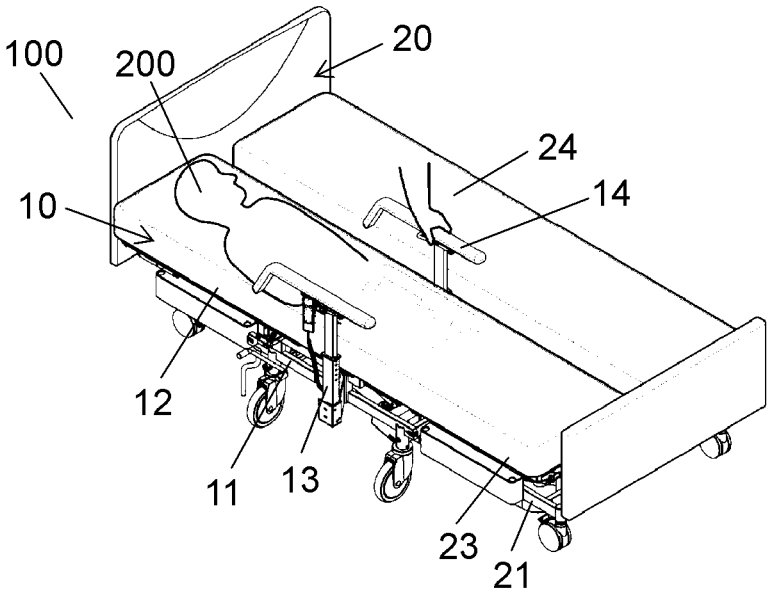
FIG. 1B is a perspective view illustrating a state in which a wheelchair section is locked in the integrated bed illustrated in FIG. 1A.
Figure 1C:
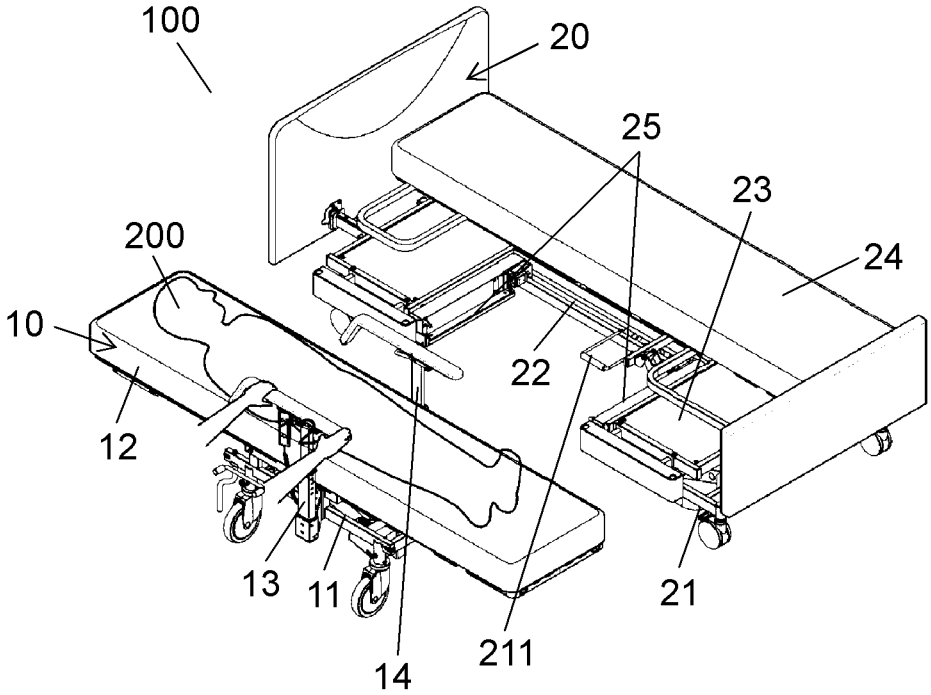
FIG. 1C is a perspective view illustrating a separated state of the integrated bed illustrated in FIG. 1A.
Figure 1D:
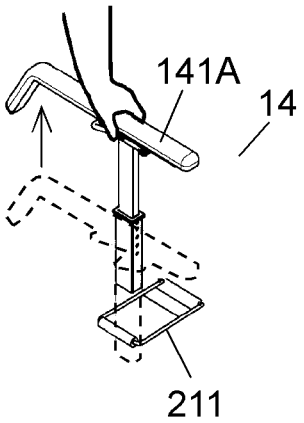
FIG. 1D is a perspective view illustrating a state in which a first armrest is pulled up in the integrated bed illustrated in FIG. 1A.

FIGS. 1A to 1C are views illustrating integrated bed 100 (hereinafter, bed 100) according to the exemplary embodiment of the present invention. FIG. 1A is a perspective view illustrating an integrated state. FIG. 1B is a perspective view illustrating a state in which wheelchair section 10 is locked by an interlock mechanism. FIG. 1C is a perspective view illustrating a separated state in which wheelchair section 10 is separated. FIG. 1D is a perspective view illustrating a state in which first armrest 14 is pulled up.

As illustrated in FIGS. 1A to 1C, bed 100 is formed of wheelchair section 10 and bed section 20.

Wheelchair section 10 includes first main body portion 11 having casters, first seat surface portion 12, first armrest 14, and second armrest 13. First seat surface portion 12 is fixed to first main body portion 11 and is capable of changing the posture thereof. First main body portion 11 is an example of a wheelchair main body. First seat surface portion 12 is an example of a wheelchair seat surface. First armrest 14 and second armrest 13 are fixed to first main body portion 11. First armrest 14 and second armrest 13 are an example of armrests. First armrest 14 is disposed on the left side of care receiver 200 and second armrest 13 is disposed on the right side of care receiver 200.

Bed section 20 includes base frame 21 having casters, elevating portion 22 fixed to base frame 21, upper frame 23, second seat surface portion 24, wheelchair fixing portion 25, and U-shaped pipe 211. The height of second seat surface portion 24 and the height of upper frame 23 can be changed by elevating portion 22. A second main body portion of bed section 20 is formed of base frame 21, elevating portion 22, upper frame 23, and wheelchair fixing portion 25. The second main body portion is an example of a bed main body portion. Second seat surface portion 24 is an example of a bed seat surface portion, and is combined with first seat surface portion 12 of wheelchair section 10 to form a bed surface of bed 100. Wheelchair fixing portion 25 is an example of a configuration for fixing wheelchair section 10.

Second seat surface portion 24 is fixed to upper frame 23 and is capable of changing the posture thereof. Wheelchair fixing portion 25 is fixed to upper frame 23, and is provided for fixing wheelchair section 10. U-shaped pipe 211 as an example of a U-shaped member is fixed to base frame 21. In other words, bed section 20 includes the second main body portion, second seat surface portion 24 fixed to the second main body portion, and the U-shaped member positioned below second seat surface portion 24 and fixed to the second main body portion.

Though the detailed description will be made below, second armrest 13 and first armrest 14 are slidable in a vertical direction, and are capable of changing a state between a pulled-up state and an accommodated state by sliding in the vertical direction. FIG. 1A illustrates a state in which second armrest 13 is pulled up and first armrest 14 is accommodated. In addition, FIG. 1B illustrates a state in which second armrest 13 and first armrest 14 are pulled up.

Here, a separation method of bed 100 will be described with reference to FIGS. 1A to 1D.

In a state in which wheelchair section 10 and bed section 20 are integrated, first, a caregiver transfers care receiver 200 to wheelchair section 10 as illustrated in FIG. 1A.

Then, the caregiver operates elevating portion 22 to lower upper frame 23 until first main body portion 11 reaches the ground. After first main body portion 11 reaches the ground, when only bed section 20 is further lowered, fixing of wheelchair section 10 by wheelchair fixing portion 25 is released. As a result, wheelchair section 10 can be moved from bed section 20. At this time, a step is formed between first seat surface portion 12 and second seat surface portion 24 such that first seat surface portion 12 is higher than second seat surface portion 24.

Then, the caregiver pulls out wheelchair section 10 up to a first separation position illustrated in FIG. 1B. At this time, in bed 100, a part (lower end) of first armrest 14 is positioned in U-shaped pipe 211 fixed to base frame 21, and is in contact with U-shaped pipe 211. Therefore, at the first separation position, wheelchair section 10 cannot be pulled out over the position.

Then, as illustrated in FIG. 1D, when an armrest top of first armrest 14 is pulled up so as to be higher than first seat surface portion 12, first armrest 14 is positioned at the outside of U-shaped pipe 211. Therefore, wheelchair section 10 can be pulled out without causing first armrest 14 to be in contact with U-shaped pipe 211. When the caregiver pulls out wheelchair section 10 in a state where first armrest 14 is pulled up, as illustrated in FIG. 1C, wheelchair section 10 can be pulled out up to a second separation position.

The first separation position indicates a position of wheelchair section 10 where a gap sufficient for pulling up first armrest 14 can be formed between wheelchair section 10 and bed section 20. That is, the first separation position is a position where wheelchair section 10 is in a state of being slightly pulled out from the integrated state. In addition, the second separation position indicates a position of wheelchair section 10 where wheelchair section 10 and bed section 20 are in a state of being completely separated from each other.

Wheelchair section 10 of the exemplary embodiment is described to have a configuration in which wheelchair section 10 is separated toward a right side of care receiver 200, but may have a configuration in which wheelchair section 10 is separated toward a left side of care receiver 200. In this case, not first armrest 14 but second armrest 13 is in contact with U-shaped pipe 211, and for the description, the configuration is that first armrest 14 is replaced with second armrest 13.

Figure 2A:
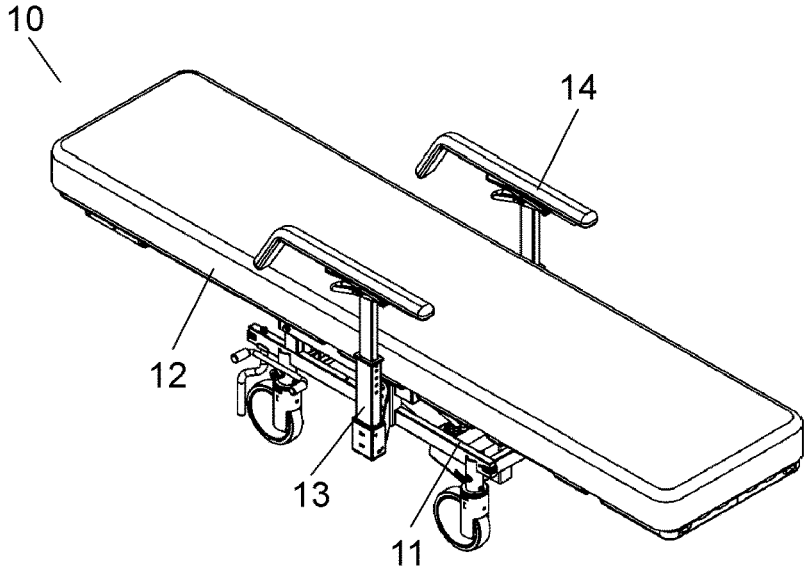
FIG. 2A is a perspective view illustrating a flat state of the wheelchair section of the integrated bed illustrated in FIG. 1A.
Figure 2B:
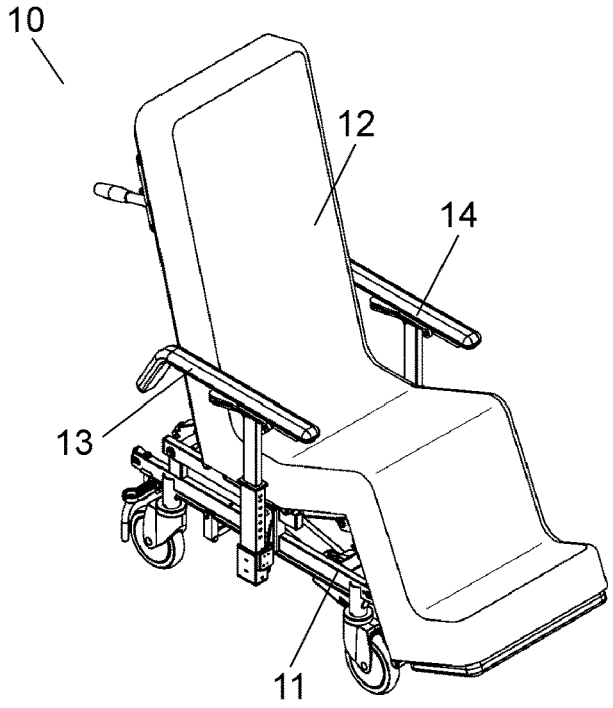
FIG. 2B is a perspective view illustrating a chair state of the wheelchair section illustrated in FIG. 2A.

FIG. 2A is a perspective view illustrating wheelchair section 10 in a flat state, and FIG. 2B is a perspective view illustrating wheelchair section 10 in a chair state. The flat state indicates a state in which first seat surface portion 12 of wheelchair section 10 is flat. The chair state indicates a state in which first seat surface portion 12 of wheelchair section 10 has a chair shape in which a backrest, a seat, footrests, and the like are formed, as illustrated in FIG. 2B. Wheelchair section 10 is configured to change the posture of first seat surface portion 12 after being separated from bed section 20. That is, the posture can be changed from the flat state in FIG. 2A to the chair state in FIG. 2B. Wheelchair section 10 in the chair state in FIG. 2B can be used as a wheelchair.

Figure 3A:
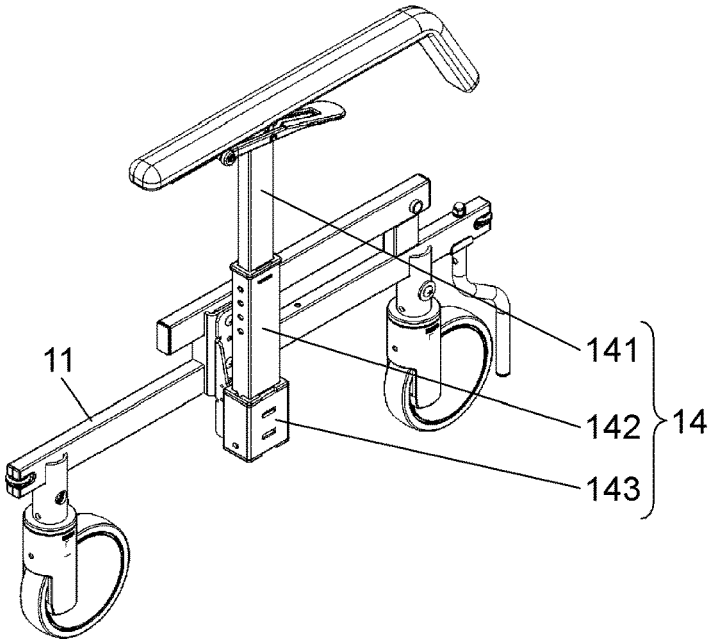
FIG. 3A is a perspective view illustrating a pulled-up state of the first armrest illustrated in FIG. 1D.
Figure 3B:
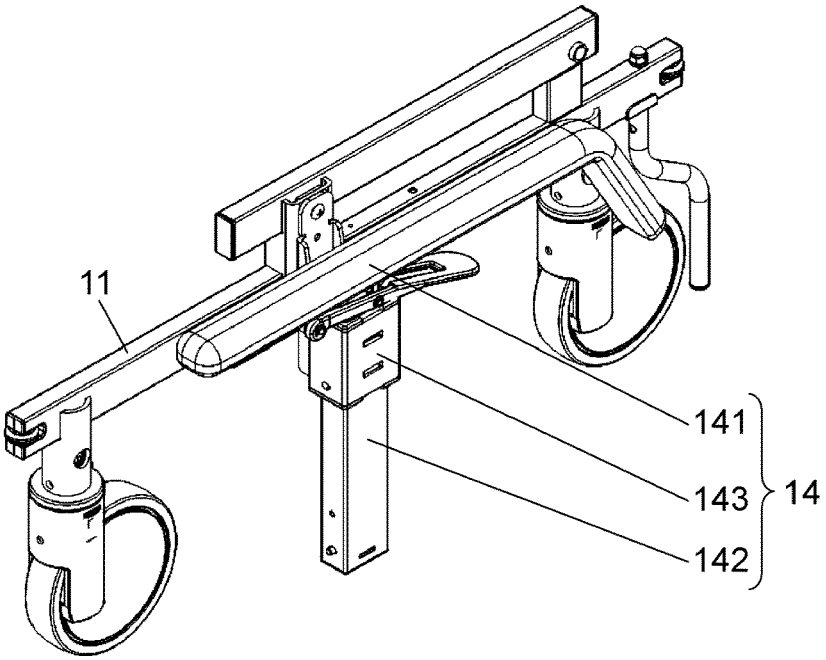
FIG. 3B is a perspective view illustrating an accommodated state of the first armrest illustrated in FIG. 3A.
Figure 4:
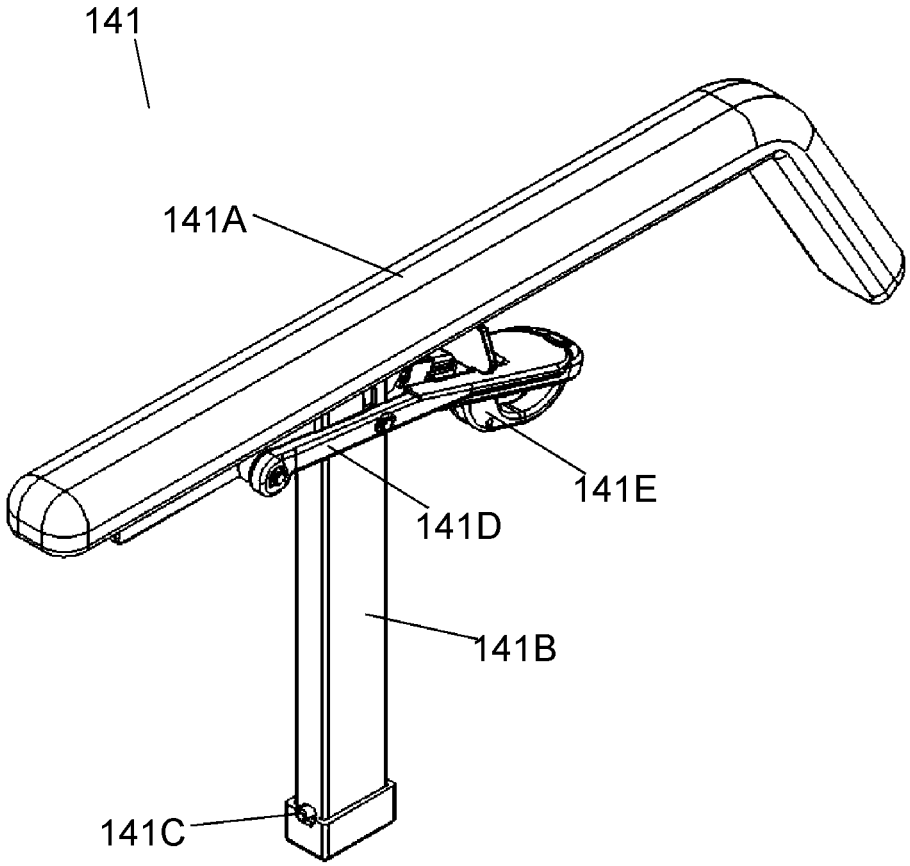
FIG. 4 is a perspective view illustrating a first component of the first armrest illustrated in FIG. 3A.
Figure 5:
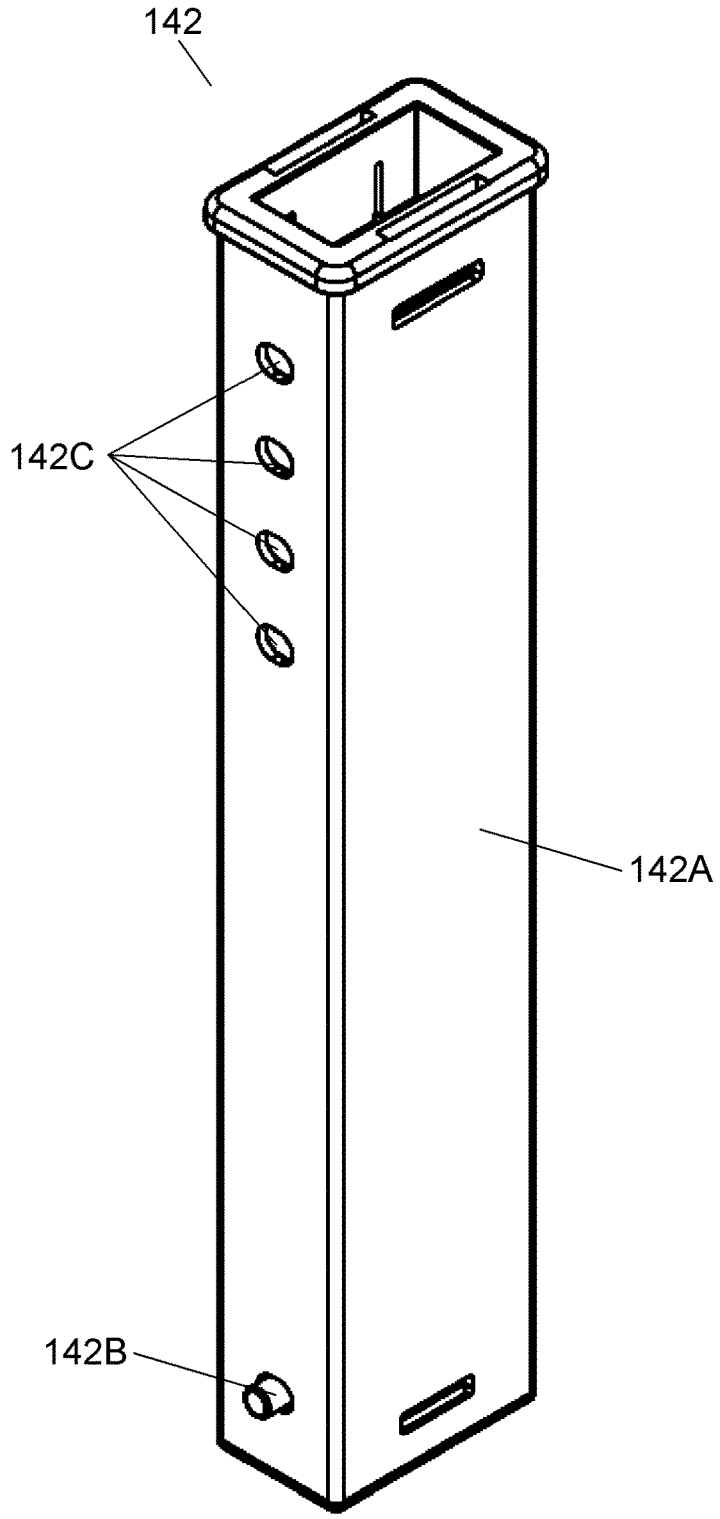
FIG. 5 is a perspective view illustrating a second component of the first armrest illustrated in FIG. 3A.
Figure 6:
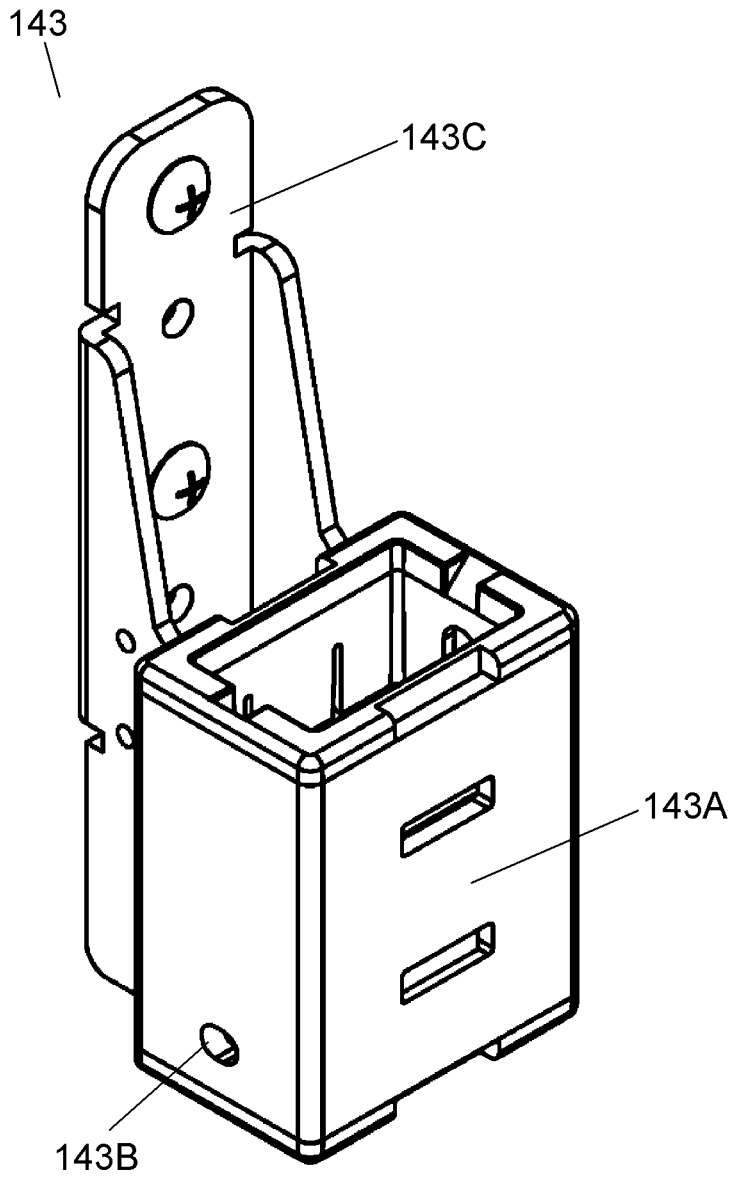
FIG. 6 is a perspective view illustrating a third component of the first armrest illustrated in FIG. 3A.

Next, the movement of first armrest 14 will be described with reference to FIGS. 3A to 6. FIG. 3A is a perspective view illustrating the pulled-up state of first armrest 14, and FIG. 3B is a perspective view illustrating the accommodated state of first armrest 14. FIGS. 4 to 6 are perspective views respectively illustrating first component 141, second component 142, and third component 143 of first armrest 14.

As illustrated in FIGS. 3A and 3B, first armrest 14 includes third component 143 fixed to first main body portion 11, second component 142 capable of moving inside third component 143 in a slidable manner, and first component 141 capable of moving inside second component 142 in a slidable manner.

As illustrated in FIG. 4, first component 141 includes armrest top 141A, first pipe 141B, first pin 141C, lever 141D, and armrest lock 141E. Armrest top 141A is a member on which the arm of care receiver 200 is placed, and is positioned at the uppermost part of first armrest 14. First pipe 141B supports armrest top 141A, and slides in second component 142. First pin 141C is provided at the lower portion of first pipe 141B. That is, first pipe 141B is fixed to armrest top 141A. First pin 141C is provided on a side opposite to armrest top 141A in an extending direction of first pipe 141B. Lever 141D is provided so as to operate first pin 141C. Armrest lock 141E is supported by lever 141D so as to be rotatable. Although not illustrated in FIG. 4, first component 141 is provided with a mechanism in which first pin 141C is settled in first pipe 141B when lever 141D is pulled up. That is, first pin 141C is provided so as to protrude from a side surface of first pipe 141B and to be settled in first pipe 141B.

Lever 141D is configured to unlock the vertical movement of first armrest 14 by a rotational movement, and armrest lock 141E is configured to unlock the rotational movement of lever 141D. The combination of lever 141D and armrest lock 141E is an example of an armrest locking mechanism. In the exemplary embodiment, by providing such an armrest locking mechanism, a configuration is achieved so that the armrest is not easily moved in the vertical direction by an unexpected motion of care receiver 200 and the caregiver can easily move the armrest in the vertical direction.

As illustrated in FIG. 5, second component 142 is formed of second pipe 142A and second pin 142B. Further, a side surface of second pipe 142A is provided with a plurality of first holes 142C. First pin 141C can be fitted into any one of first holes 142C. As first pin 141C is fitted into one of first holes 142C, the position of first component 141 is fixed with respect to second component 142. Although not illustrated in FIG. 5, a lower part of second pipe 142A is provided with a mechanism in which second pin 142B is settled in second pipe 142A when first component 141 slides to be positioned at the lower part. That is, second pipe 142A allows first pipe 141B to be inserted therethrough and is provided with first holes 142C into which first pin 141C can be fitted. Second pin 142B is provided on a side opposite to first hole 142C in an extending direction of second pipe 142A, and is provided so as to protrude from the side surface of second pipe 142A and to be settled in second pipe 142A.

As illustrated in FIG. 6, third component 143 is formed of third pipe 143A and second fixing portion 143C joined with third pipe 143A and fixed with first main body portion 11 by using screws and the like. A side surface of third pipe 143A is provided with second hole 143B. When second pin 142B is fitted into second hole 143B, second component 142 is fixed to third component 143.

Here, the movement from the pulled-up state shown in FIG. 3A to the accommodated state shown in FIG. 3B will be described. First, the caregiver operates armrest lock 141E so as to unlock lever 141D, and grips lever 141D for operating first pin 141C so that first pin 141C is pulled out from first hole 142C. By this operation, the fixation of first component 141 with respect to second component 142 is released. The method of locking and unlocking armrest lock 141E will be described later. As a result, first component 141 can freely slide with respect to second component 142. In this state, when the caregiver pushes down first component 141 to a lower side so that the lower part of first component 141 comes in contact with second pin 142B, second pin 142B is operated to be pulled out from second hole 143B. By this operation, the fixation of second component 142 with respect to third component 143 is released. As a result, second component 142 can freely slide with respect to third component 143. In this state, when the caregiver pushes down first component 141, second component 142 is accommodated in third component 143 to obtain the accommodated state illustrated in FIG. 3B. Then, when the caregiver releases lever 141D, first component 141, second component 142, and third component 143 are fixed to each other.

A pulling-up operation (raising operation) is the opposite operation of the pushing-down operation (lowering operation) described above. First, the caregiver pulls up first component 141 which can be freely operated. Accordingly, first pin 141C is fitted into one of first holes 142C, and thus first component 141 is fixed to second component 142. In this state, when first component 141 is pulled up further, second pin 142B is fitted into second hole 143B, and thus second component 142 is also fixed to third component 143.

Figure 7A:
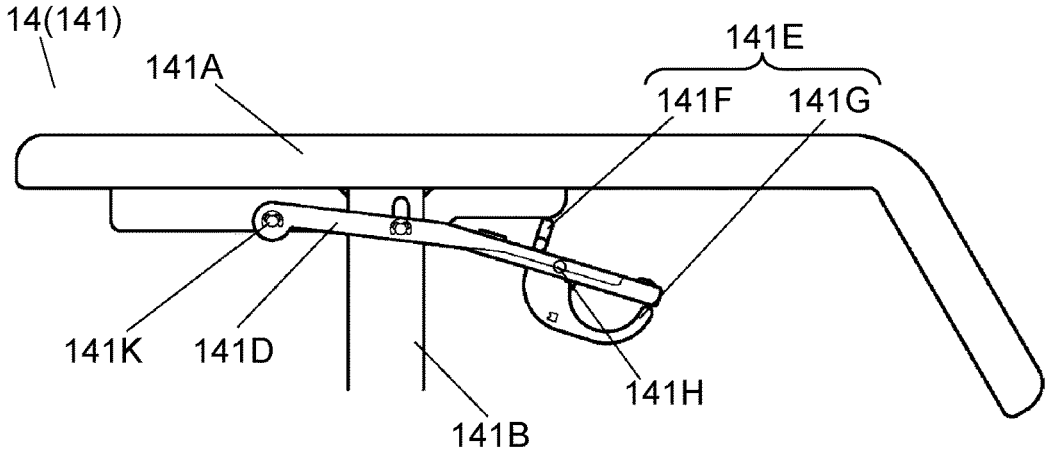
FIG. 7A is a side view illustrating a state in which an armrest locking mechanism according to the exemplary embodiment of the present invention is locked.
Figure 7B:
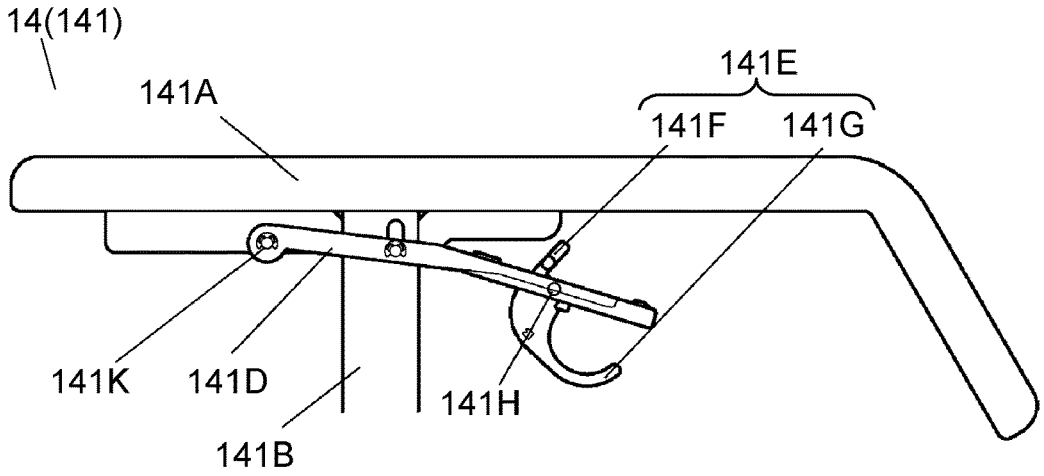
FIG. 7B is a side view illustrating a state in which the armrest locking mechanism illustrated in FIG. 7A is unlocked.
Figure 7C:
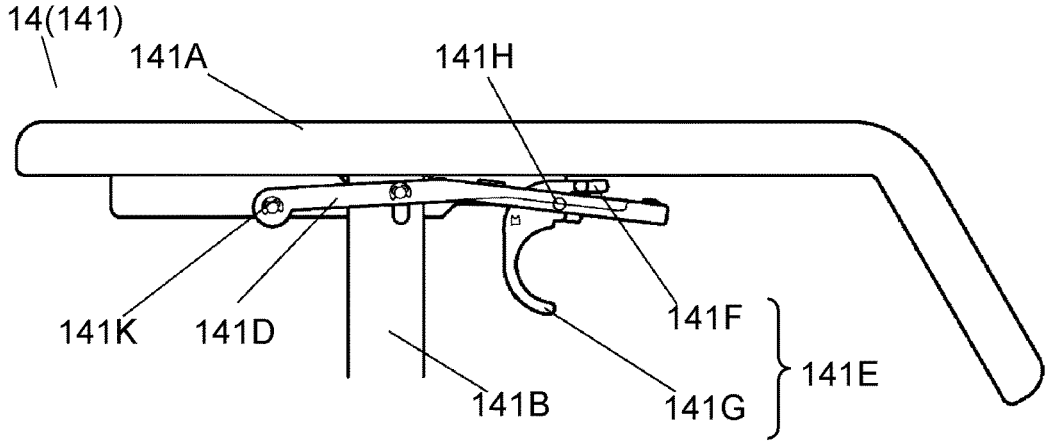
FIG. 7C is a side view illustrating a state in which a lever of the armrest locking mechanism illustrated in FIG. 7A is pulled up.
Figure 8:
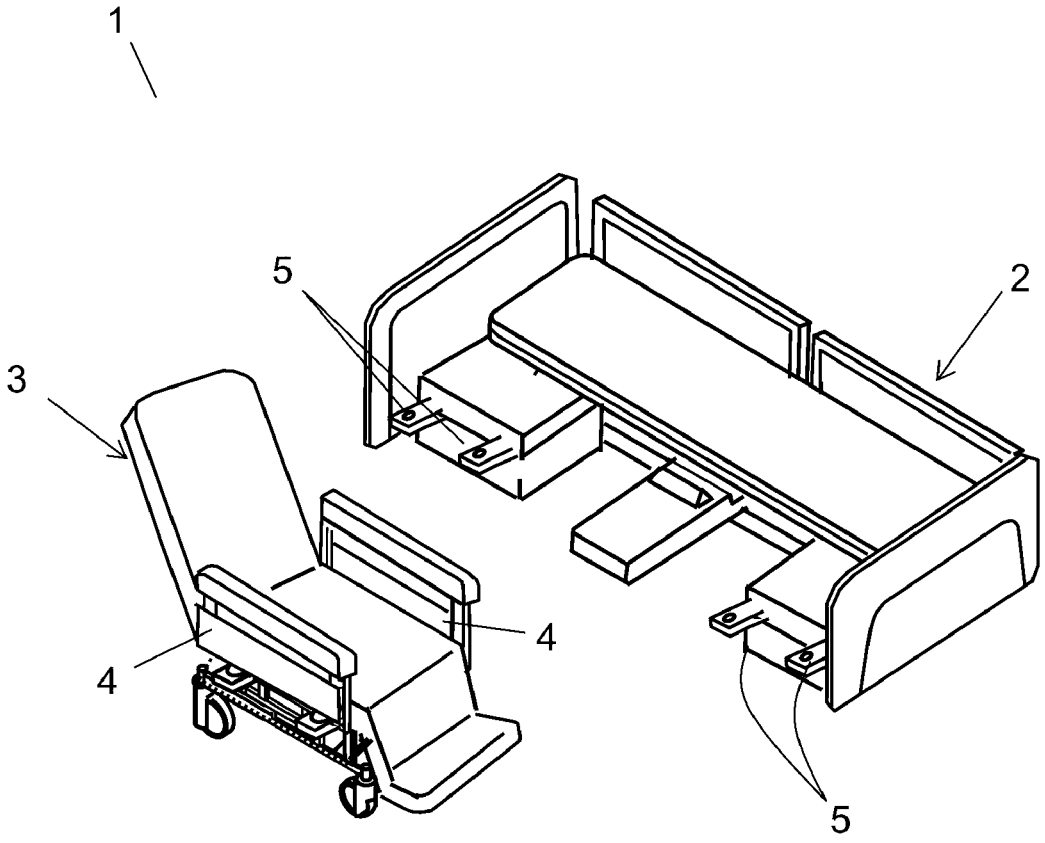
FIG. 8 PRIOR ART
FIG. 8 is a perspective view of a bed in the related art.

FIGS. 7A to 7C are views illustrating an armrest locking mechanism according to the exemplary embodiment. FIG. 7A illustrates a state in which the movement of first armrest 14 is locked. FIG. 7B illustrates a state in which the movement of first armrest 14 is unlocked. FIG. 7C illustrates a state in which lever 141D is pulled up in order to move first armrest 14. The armrest locking mechanism according to the exemplary embodiment is configured such that the vertical movement of first armrest 14 is not unlocked unless the armrest locking mechanism is operated in a direction in which an arm of care receiver 200 is stretched (in a direction toward tip end side of first armrest 14, leg side of wheelchair section 10, or in a front direction of care receiver 200 in a sitting state) in the vicinity of an elbow of care receiver 200 who has sat on wheelchair section 10. With this configuration, the armrest is not easily moved in the vertical direction by an unexpected motion of care receiver 200, and the caregiver can easily move the armrest in the vertical direction.

Armrest lock 141E is formed of lock contacting portion 141F and lock operating portion 141G, and is supported to rotate around lock rotational shaft 14111 with respect to lever 141D. In addition, a tip end of armrest lock 141E is usually biased to be at a position illustrated in FIG. 7A. That is, armrest lock 141E is biased in a direction in which the movement of lever 141D is locked such that the tip end of armrest lock 141E is positioned between armrest top 141A and lever 141D. Armrest lock 141E is biased by an elastic member (not illustrated) such as a spring. As the elastic member, a helical spring, which connects lever 141D and lock contacting portion 141F or lock operating portion 141G, can be used.

Lever 141D is supported to rotate around lever rotational shaft 141K that is provided at the tip end side (left side of FIG. 7A) of armrest top 141A with respect to first pipe 141B, which is a supporting strut of first armrest 14, as a center. Lever 141D is configured such that the vertical movement of first armrest 14 is not unlocked unless Lever 141D is operated in a direction in which an arm of care receiver 200 is bent (in a direction toward rear end side of first armrest 14, head side of wheelchair section 10, or in a rear direction of care receiver 200 in a sitting state).

When armrest lock 141E is in a state illustrated in FIG. 7A, if there is an attempt to just pull up lever 141D, lock contacting portion 141F of armrest lock 141E comes in contact with armrest top 141A, and thus lever 141D is not pulled up. Accordingly, first component 141 is not vertically moved. When lock operating portion 141G is operated to cause armrest lock 141E to rotate (twist) around lock rotational shaft 14111 as illustrated in FIG. 7A, lock contacting portion 141F is moved so that lever 141D can be pulled up as illustrated in FIG. 7C. In this state, when lever 141D is pulled up, first component 141 can be vertically moved.

In order to unlock lever 141D, first, the caregiver hooks his/her finger into lock operating portion 141G, and then moves the finger toward him/her (toward the tip end of armrest top 141A or the left side of FIG. 7A) as it is. By this operation, armrest lock 141E twists around lock rotational shaft 141H. Then, as described above, lock contacting portion 141F is moved to a position at which lock contacting portion 141F is not in contact with armrest top 141A. As a result, as illustrated in FIG. 7C, lever 141D can be pulled up. That is, armrest lock 141E is configured such that, when lever 141D is unlocked and lever 141D is twisted, the tip end of armrest lock 141E is separated from a position at which the tip end is in contact with first armrest 14. In this manner, the rotational movement of lever 141D is not unlocked unless armrest lock 141E is operated in a direction in which an arm of care receiver 200 is stretched (toward the tip end of first armrest 14, the leg of wheelchair section 10, or in a front direction of care receiver 200 in a sitting state). In addition, as described above, in the armrest locking mechanism according to the exemplary embodiment, the caregiver can perform, with one hand, an operation from unlocking and pulling up lever 141D to accommodating first armrest 14.

In bed 100, as illustrated in FIGS. 1A to 1C, when wheelchair section 10 is integrated/separated, the caregiver has to move first armrest 14 by stretching a hand from the vicinity of second armrest 13 of wheelchair section 10 in order to accommodate first armrest 14. Therefore, in order for easy usage of the caregiver, first armrest 14 is necessarily moved with one hand. In the armrest locking mechanism according to the exemplary embodiment, as described above, it is possible to perform, with one hand, an operation from unlocking lever 141D to accommodating first armrest 14. Therefore, the caregiver easily operates the locking mechanism.

The rotational direction of lever 141D and the rotational direction of armrest lock 141E for the unlocking operation are not limited to those described above. However, it is preferable that the rotational direction of armrest lock 141E when unlocking the rotational movement of lever 141D is opposite to the rotational direction of lever 141D when unlocking the vertical movement of first armrest 14. It is desirable to make the armrest locking mechanism have such a configuration. If the rotational directions for the unlocking operations are opposite to each other, it is possible to decrease the possibility that first armrest 14 is moved downward due to an unexpected motion of care receiver 200.

In addition, it is preferable to configure armrest lock 141E such that armrest lock 141E is rotated toward the front side of wheelchair section 10 so as to unlock the rotational movement of lever 141D. In this manner, it is possible to improve the usability.

It is preferable to configure lever 141D such that lever 141D is rotated toward the front side of wheelchair section 10 so as to unlock the vertical movement of first armrest 14. In this manner, it is possible to further improve the usability.

Lever 141D may unlock the movement of first armrest 14 by using a movement other than the rotational movement. However, from the view point of usability, the rotational movement described above is the most suitable. Armrest lock 141E may unlock the movement of lever 141D by using a movement other than the rotational movement. However, from the view point of usability, the rotational movement described above is the most suitable.

It is desirable that lever 141D and armrest lock 141E are positioned below armrest top 141A because lever 141D and armrest lock 141E do not interfere with care receiver 200.

In the above description, first armrest 14 is described, but second armrest 13 may have the same configuration and function. That is, bed 100 includes bed section 20 as the bed main body portion, and wheelchair section 10 capable of being separated from bed section 20. In bed 100, of both side surfaces of wheelchair section 10, at least a side surface facing bed section 20 is provided with an armrest having the armrest locking mechanism.

An armrest locking mechanism according to the present disclosure is useful to be applied to a wheelchair and a bed for caring of an aged person or a sick person who is bedridden by separating a part of a bed to be a wheelchair.

What is claimed is:

1. An armrest locking mechanism configured to lock a vertical movement of an armrest provided to a wheelchair section, the armrest including an armrest top on which an arm of a care receiver is placed, the mechanism comprising:

a lever configured to unlock the vertical movement of the armrest, the lever being supported to rotate around a lever rotational shaft that is provided at a tip end side of the armrest top;

an armrest lock configured to unlock a rotational movement of the lever, the armrest lock being formed of a lock contacting portion and a lock operating portion, and is supported to rotate around a lock rotational shaft with respect to the lever; and a spring connecting the lever and the lock contacting portion or the lock operating portion, wherein the spring biases the armrest lock such that the lock contacting portion contacts a bottom face of the armrest top, and the rotational movement of the lever is locked, and the lever is configured such that the vertical movement of the armrest is not unlocked unless the lock operating portion is operated around the lock rotational shaft in a direction away from the armrest top.

2. The armrest locking mechanism according to claim 1, wherein a rotational direction of the armrest lock to unlock the rotational movement of the lever is opposite to a rotational direction of the lever to unlock the vertical movement of the armrest.

* * * * *